US005515080A

United States Patent [19]

Nakamura et al.

[11] Patent Number: 5,515,080

[45] Date of Patent: May 7, 1996

[54] TFT LCD CONTROL METHOD FOR SETTING DISPLAY CONTROLLER IN SLEEP STATE WHEN NO ACCESS TO VRAM IS MADE

[75] Inventors: Nobutaka Nakamura; Hiroki Zenda, both of Tokyo, Japan

[73] Assignee: Kabushiki Kaisha Toshiba, Kawasaki, Japan

[21] Appl. No.: 108,293

[22] Filed: Aug. 19, 1993

Related U.S. Application Data

[63] Continuation of Ser. No. 816,587, Jan. 3, 1992, abandoned.

[30] Foreign Application Priority Data

Jan. 8, 1991 [JP] Japan ..... 3-000539
Jan. 31, 1991 [JP] Japan ..... 3-011263

[51] Int. Cl.[6] ..... G09G 5/36

[52] U.S. Cl. ..... 345/189; 345/87; 345/99

[58] Field of Search ..... 345/55, 60, 87, 345/92, 98, 99, 100, 190, 191, 200, 203, 189

[56] References Cited

U.S. PATENT DOCUMENTS 4,695,838 9/1987 Ellis, Jr. ..... 340/799
4,796,203 1/1989 Roberts ..... 340/798
4,820,222 4/1989 Holmberg et al. ..... 340/784

FOREIGN PATENT DOCUMENTS

0256879A2 2/1988 European Pat. Off. .
0288168A2 10/1988 European Pat. Off. .
0456012A2 11/1991 European Pat. Off. .
2105112 4/1990 Japan .
0217893 8/1990 Japan ..... 340/784

OTHER PUBLICATIONS

"A New Image World," published Jan. 31, 1983 (Japanese language document with English translation).

*Primary Examiner*—Richard Hjerpe
*Assistant Examiner*—Matthew Luu
*Attorney, Agent, or Firm*—Finnegan, Henderson, Farabow, Garrett & Dunner

[57] ABSTRACT

An apparatus that saves power consumption by reading out display data from a memory and writing data to a display device such that the read operation is set in a sleep state when a same screen display content continues for a predetermined period of time.

17 Claims, 6 Drawing Sheets

ADDRESS

READ

READ DATA

WRITE DATA

WRITE

COMPARE A

COMPARE B

COMPARE C

TFT LCD CONTROL METHOD FOR SETTING DISPLAY CONTROLLER IN SLEEP STATE WHEN NO ACCESS TO VRAM IS MADE

This application is a continuation of application Ser. No. 07/816,587, filed Jan. 3, 1992, now abandoned.

BACKGROUND OF THE INVENTION

1. Field of the Invention

The present invention relates to an electronic apparatus, which uses a display device such as a TFT (Thin Film Transistor) active matrix type liquid crystal display (to be referred to as a TFT LCD hereinafter) for holding display data in units of pixels.

2. Description of the Related Art

In recent years, electronic apparatuses such as personal computers have been rendered compact and lightweight, so that they can be easily carried and used anywhere. Furthermore, in order to allow a long-time use of the electronic apparatus using a battery power supply, compact, lightweight batteries having a large electric capacity, and power saving mechanisms of the electronic apparatuses have been developed.

An automatic sleep mode is an example of a power saving mechanism. In this mode, when no keyboard input is detected for a predetermined period of time, a system is automatically set in a sleep state. Thereafter, when a keyboard input is detected, the system is returned to a normal operation state.

In a screen display operation of a conventional electronic apparatus, which comprises a display device such as a CRT (cathode ray tube), a plasma display, an STN type LCD, or the like, a read operation of display data from a VRAM (video RAM), an output operation of display data to the display device, and a screen display on the display device are periodically performed independently of the presence/absence of a change in display content on the screen. This is because, in this display device, the screen display disappears when display data are not periodically supplied. Also, in an electronic apparatus, which comprises a display device such as a TFT LCD having a function of storing display data in units of pixels, a read operation of display data from a VRAM, an output operation of display data to the display device, and a screen display on the display device are periodically performed.

Since the TFT LCD originally has a function of storing display data in units of pixels, when the same screen display content continues, the read operation of display data from the VRAM is actually unnecessary. A state wherein the same screen display content continues occurs very frequently. For example, when a wordprocessor software program is used in a personal computer, an operator does not often change a screen display content when he or she thinks of a composition in front of the display screen or when the computer is executing complicated computation processing. Such a state also occurs when data on a window, which is not displayed on the screen, is rewritten in an operation using a window function, or when the same data is input at the same position. However, in a conventional system, a VRAM, a display controller, and the display device are always operated to perform a screen display, and power consumption of the screen display operation cannot be reduced.

SUMMARY OF THE INVENTION

It is an object of the present invention to provide an electronic apparatus, which can save power consumption required for reading out display data from a VRAM or writing data on a display device while the display data is kept displayed, in such a manner that a read operation of display data from the VRAM is set in a sleep state when the same screen display content continues for a predetermined period of time.

According to the first aspect of the present invention, an electronic apparatus comprises a VRAM for storing display data, a TFT LCD for holding display data output from the VRAM, and displaying the display data in units of pixels, a display controller for reading out display data from the VRAM at predetermined time intervals, and supplying read-out data to the TFT LCD, and a detector for detecting if display data stored in the VRAM have not been rewritten for a predetermined period of time. When the detector detects that display data have not been rewritten for the predetermined period of time, the display controller sleeps the read operation of display data from the VRAM.

According to a second aspect of the present invention, the VRAM has a first display data storage area for storing display data which are being displayed on the TFT LCD, and a second display data storage area for storing display data, which are not displayed on the TFT LCD, and the apparatus further comprises a display data rewrite detector for detecting whether or not display data stored in the first display data storage area have not been rewritten for a predetermined period of time. When the display data rewrite detector detects that display data stored in the first display data storage area have not been rewritten, the display controller sets the read operation of display data from the VRAM in a sleep state.

According to a third aspect of the present invention, the apparatus further comprises a coincidence detector for detecting whether or not rewritten data in the VRAM is the same as data before rewriting, and a second detector for, when the coincidence detector detects that rewritten data in the VRAM is the same as data before rewriting, determining that display data have not been rewritten, and detecting that display data stored in the VRAM have not been rewritten for a predetermined period of time. When the second detector detects that display data have not been rewritten, the display controller sets the read operation of display data from the VRAM in a sleep state.

According to a fourth aspect of the present invention, an electronic apparatus comprises a keyboard, a VRAM for storing display data input from the keyboard, a controller for reading out display data from the VRAM, a TFT LCD for holding display data read out by the controller in units of pixels, and displaying the display data, a detector for detecting if a state, wherein data has not been input from the keyboard for a predetermined period of time, continues, and a circuit for, when the detector detects that a data input has not been made for the predetermined period of time, setting the read operation of display data by the controller in a sleep state.

According to the present invention, when display data stored in the VRAM have not been rewritten for a predetermined period of time, the read operation of display data from the VRAM is set in a sleep state. Thus, power consumption required for reading out display data from the VRAM, and writing data on a display device can be saved while the TFT LCD maintains its display content.

When display data stored in the first display data storage area for storing data, which are being displayed on the TFT LCD, have not been rewritten for a predetermined period of time, the read operation of display data from the VRAM is set in a sleep state. Therefore, power consumption required for reading out display data from the VRAM, and writing data on a display device can be saved while the TFT LCD maintains its display content.

Furthermore, the coincidence detector detects that data to be rewritten is the same as data before rewriting, and informs this to the second detector. Based on this information, the second detector determines that display data have not been rewritten, and detects that display data stored in the VRAM have not been rewritten for a predetermined period of time. Upon this detection, the display controller sets the read operation from the VRAM in a sleep state. Therefore, since a content on the display device can be prevented from being wastefully rewritten with the same data, power consumption can be saved.

Furthermore, only when display data is rewritten by the keyboard, display data is read out from the VRAM, thus saving power consumption.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
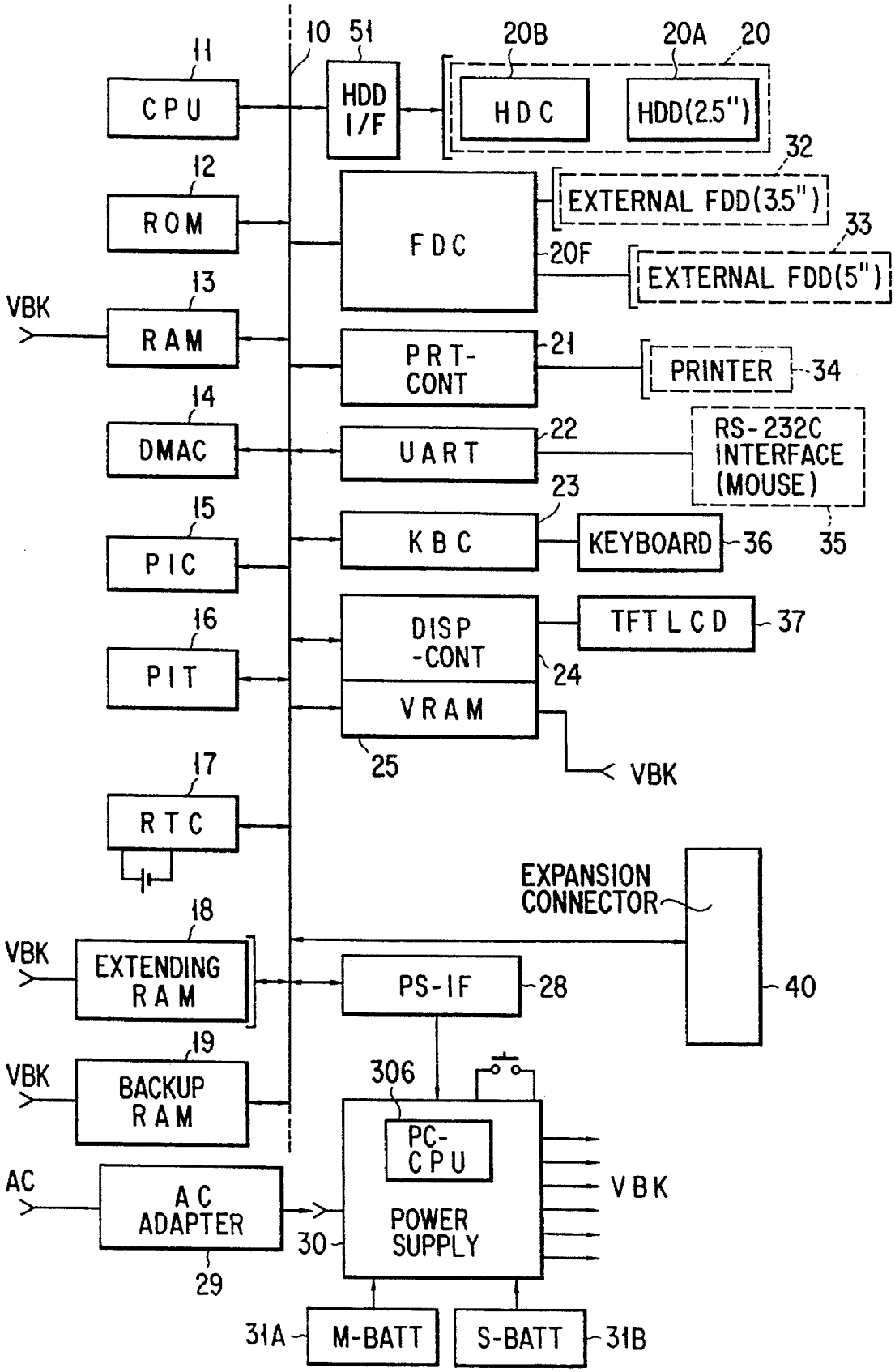
FIG. 1 is a system block diagram showing an embodiment of an electronic apparatus according to the present invention.

FIG. 1 is a system block diagram showing a portable computer according to the present invention.

In FIG. 1, components 11–28, and 51 are connected to a system bus 10. A CPU (Central Processing Unit) 11 controls the overall system. The CPU 11 serves as a host CPU (PC-CPU) when viewed from a power control CPU 306 of a power supply 30 (to be described later). A ROM (Read Only Memory) 12 stores a BIOS (basic input and output program). The BIOS is executed in response to a power supply of the system, and loads setup information stored in a specific area (or register) of a RAM (Random Access Memory) 13 so as to determine system environments. Thereafter, the BIOS reads out a boot block from an HDD (hard disk drive) 20A, and loads an OS (operating system program) stored in the HDD 20A to the RAM 13 using the boot block. The RAM 13 stores the OS, application programs, various data, and the like. The RAM 13 is supplied with a backup power supply voltage VBK from the power supply 30, so that its memory content can be prevented from being erased even when the system power supply is turned off. A DMA (Direct Memory Access) controller 14 performs DMA control. A controller 15 is a programmable interrupt controller. A timer 16 is a programmable interval timer. When the interval timer 16 measures a programmed time, it supplies a time-out signal to the CPU 11 as an interrupt signal under the control of the programmable interrupt controller 15. In response to this interrupt signal, the CPU 11 executes a vector interrupt processing routine. An RTC (real-time clock) 17 is a timepiece module, having its own operation power supply, for displaying current time. An extending RAM 18 is a large-capacity memory, which can be inserted in or removed from a special-purpose card slot of a main body, and is supplied with the backup power supply voltage (VBK). A backup RAM 19 is a data preservation area for realizing a resume function, and is supplied with the backup power supply voltage (VBK). An HDD interface 51 interfaces between the CPU 11 and an HDD pack 20. The HDD pack 20 can be desirably inserted in or removed from a special-purpose storage portion of the main body, and comprises, e.g., a 2.5" HDD 20A and an HDC (hard disk controller) 20B for access-controlling the HDD 20A. An FDC (floppy disk controller) 20F controls a 3.5" external FDD (floppy disk drive) 33 connected as an optional device. A printer controller 21 is connected to a printer 34 externally connected to the main body. An I/O interface 22 is a UART (Universal Asynchronous Receiver/Transmitter), and an RS-232C interface device is connected to the I/O interface 22, as needed. A keyboard controller 23 controls a keyboard 36.

A display controller 24 controls an LCD (liquid crystal display) 37. The display controller 24 has a function of writing display data in a VRAM (video RAM) 25 upon receipt of a write command from the CPU 11 to the VRAM 25, and a function of reading out display data from the VRAM 25 and supplying the readout data to the LCD 37. The LCD 37 has a function of holding display data in units of pixels in, e.g., a TFT (Thin Film Transistor) LCD, and of visually displaying display data. The VRAM 25 is supplied with the backup power supply voltage (VBK), and stores video data. A power supply control interface (PS-IF) 28 connects the power supply 30 to the CPU 11 through the system bus 10. A power supply adapter 29 is plug-connected to the personal computer main body so as to rectify and smooth a commercial AC power supply to obtain a DC operation power supply of a predetermined potential. An expansion unit is selectively connected to an expansion connector 40. The intelligent power supply (power supply) 30 comprises the power control CPU 306, and supplies electric power to the above-mentioned units. A battery M-BATT 31A is a detachable main battery pack comprising a rechargeable battery S-BATT. A battery 31B is a sub battery comprising a rechargeable battery, and equipped in the main body.

Figure 2:
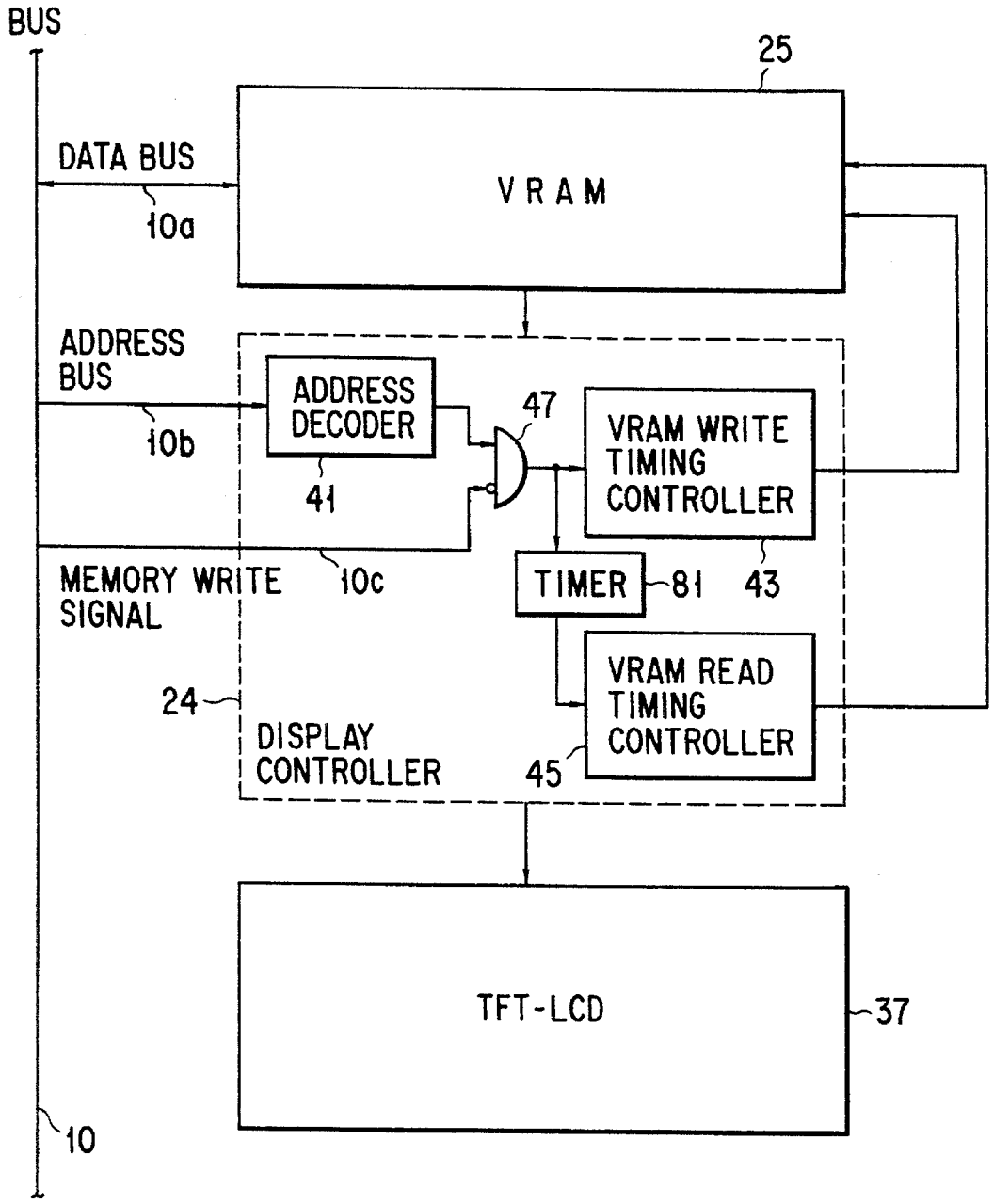
FIG. 2 is a detailed block diagram of a display controller shown in FIG. 1.

FIG. 2 is a detailed block diagram of the display controller 24 shown in FIG. 1. In FIG. 2, an address decoder 41 decodes an address signal input through an address bus 10*b*, and if the address signal indicates an address of the VRAM 25, the decoder 41 outputs a high-level signal "H". A VRAM write timing controller 43 controls write timings of display data supplied through a data bus 10*a*. A VRAM read timing controller 45 controls read timings for reading out display data from the VRAM 25 so as to perform read operations at predetermined time intervals. An AND gate 47 detects that the content of the VRAM 25 is rewritten. More specifically, the positive input terminal of the AND gate 47 receives an output from the address decoder 41, and the negative input terminal thereof receives a memory write signal (active low). Assuming that display data stored in the VRAM 25 are rewritten, since the address decoder 41 detects an address of the VRAM 25, it supplies a high-level signal "H" to the AND gate 47. Furthermore, since the CPU 11 sets a memory write signal at a low level, a high-level signal obtained by inverting the low-level memory write signal is supplied to the AND gate 47. As a result, the AND gate 47 supplies a high-level signal to the VRAM write timing controller 43 and a timer 81. The timer 81 counts a period of time between adjacent display data rewrite operations. When the counted time interval exceeds a predetermined period of time, the timer 81 sends a signal for setting a sleep state to the VRAM read timing controller 45.

An operation of the embodiment of the present invention with the above arrangement will be described below.

When the CPU 11 writes display data in the VRAM 25, it outputs an address signal and a memory write signal (low-level signal "L") together with the display data. The address signal sent through the address bus **10*b* is supplied to the address decoder 41. The address decoder 41 decodes the supplied address signal, and outputs a high-level signal "H" only when the address signal indicates an address of the VRAM 25. The AND gate 47 receives a signal output from the address decoder 41, and the memory write signal output from the CPU 11 through a control bus 10*c*. When the output from the address decoder 41 is the high-level signal "H", and the memory write signal is the low-level signal "L", the AND gate 47 outputs a high-level signal "H" to the VRAM write timing controller 43. The high-level signal "H" 10 indicates that the display data stored in the VRAM 25** is rewritten.

Upon reception of the high-level signal "H" from the AND gate 47, the VRAM write timing controller 43 generates a timing signal for storing the display data supplied through the data bus **10*a* at the designated address of the VRAM 25**.

The output signal from the AND gate 47 is supplied to the timer 81. When the output signal from the AND gate 47 becomes a high-level signal "H", the timer 81 is reset, and starts a counting operation. At this time, the output from the timer 81 is a low-level signal "L" (indicating that VRAM read access is enabled). The timer 81 performs the counting operation until the next high-level signal "H" is input from the AND gate 47 or until its count value reaches a predetermined value. When the count value reaches the predetermined value, the timer 81 supplies a high-level signal "H" (indicating that the VRAM read access is set in a sleep state) to the VRAM read timing controller 45. When the signal supplied from the timer 81 is a signal "H" indicating that the VRAM read access is set in a sleep state, the VRAM read timing controller 45 is shifted to a sleep state, thus setting a read operation of display data from the VRAM 25 in a sleep state. When the output from the timer 81 is a signal "L" indicating that the sleep state of the VRAM read access is released, the VRAM read timing controller 45 reads out data from the VRAM 25 at predetermined time intervals.

In this manner, when display data have not been changed for a predetermined period of time, no display data is sent to the LCD 37. Thus, power consumption can be saved.

Figure 3:
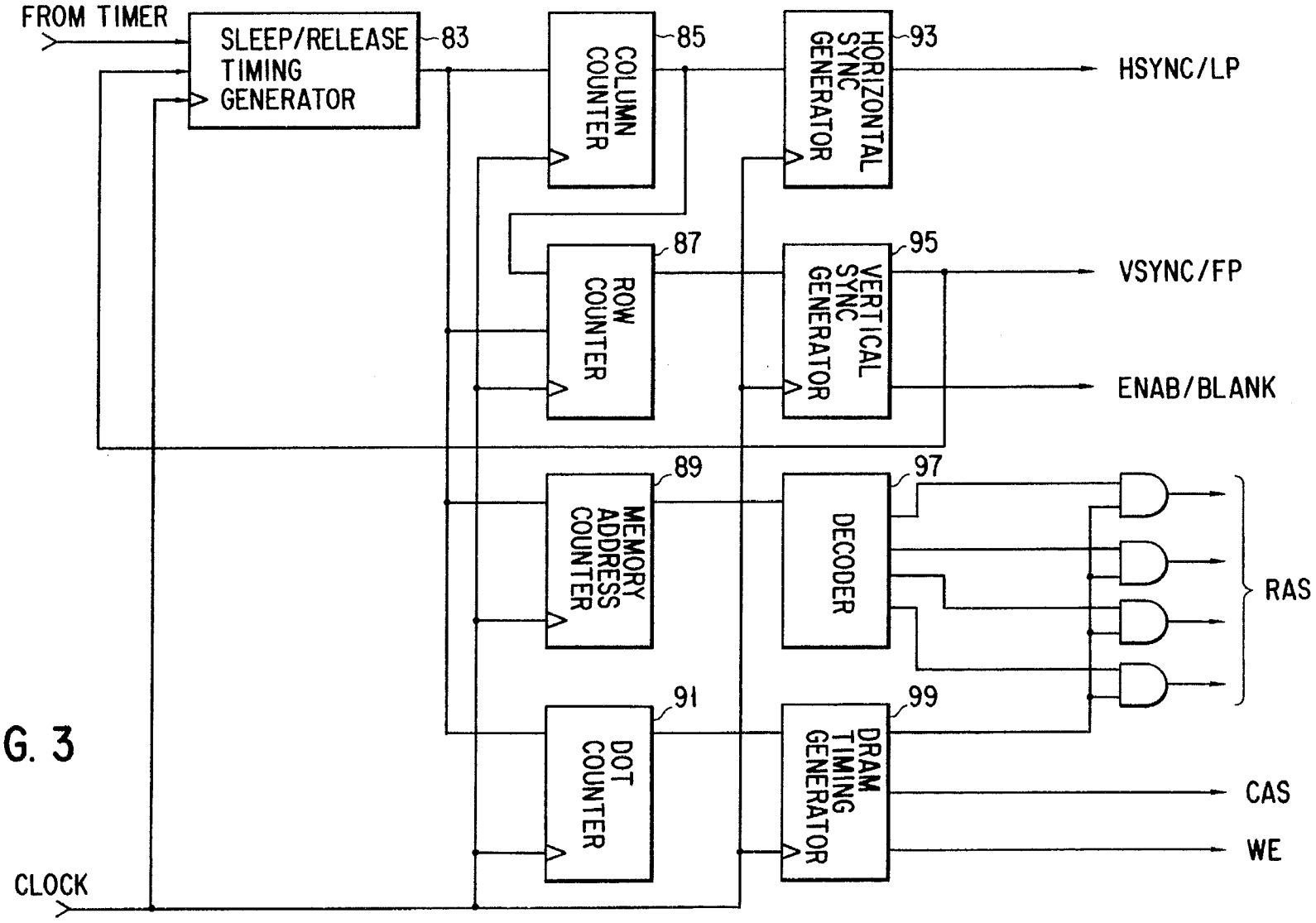
FIG. 3 is a detailed block diagram showing a controller for setting a read operation of display data in a sleep state.

FIG. 3 is a detailed block diagram of a controller for setting the VRAM read timing controller 45 in a sleep state. A sleep/release timing controller 83 receives a sleep or release signal from the timer 81, a clock signal from a clock circuit (not shown), and a vertical sync signal from a vertical sync generator 95 (to be described later), and outputs a sleep or release timing signal to counters 85, 87, 89, and 91 (to be described later). The column counter 85 and the row counter 87 respectively count the numbers of columns and rows of the display screen. For example, when the display resolution is 640×480 dots, the column counter 85 counts a value ranging between 0 and 639, and the row counter 87 counts a value ranging between 0 and 479. The memory address counter 89 counts an address of the VRAM 25, e.g., a value ranging between 0 and (256K−1). Furthermore, the dot counter 91 counts dots (0 through 7) of one byte. When the column counter 85 completes a count operation of "639" columns, a horizontal sync generator 93 outputs a horizontal sync signal. When the row counter 87 completes a count operation of "479" rows, the vertical sync generator 95 generates a vertical sync signal. A decoder 97 decodes an address signal from the memory address counter 89, and outputs an RAS (row address strobe) signal to respective memory chips (four chips in this embodiment). A DRAM timing generator 99 outputs a CAS (column address strobe) signal and a WE (write enable) signal on the basis of a dot count value from the dot counter 91. In a normal operation, a clock signal is supplied to the counters 85, 87, 89, and 91, and these counters are operated. Upon reception of a sleep control signal from the timer 81, the sleep/release timing generator 83 logically ANDs the sleep control signal and the vertical sync signal. When both the signals are significant signals, the generator 83 supplies a sleep signal to the counters 85, 87, 89, and 91. As a result, the counters 85, 87, 89, and 91 are set in a sleep state. The sleep control signal from the timer 81 and the vertical sync signal are logically ANDed to set the counters in a sleep state not immediately after the sleep signal is supplied from the timer 81, but after the display operation of the display screen is completed.

Figure 4:
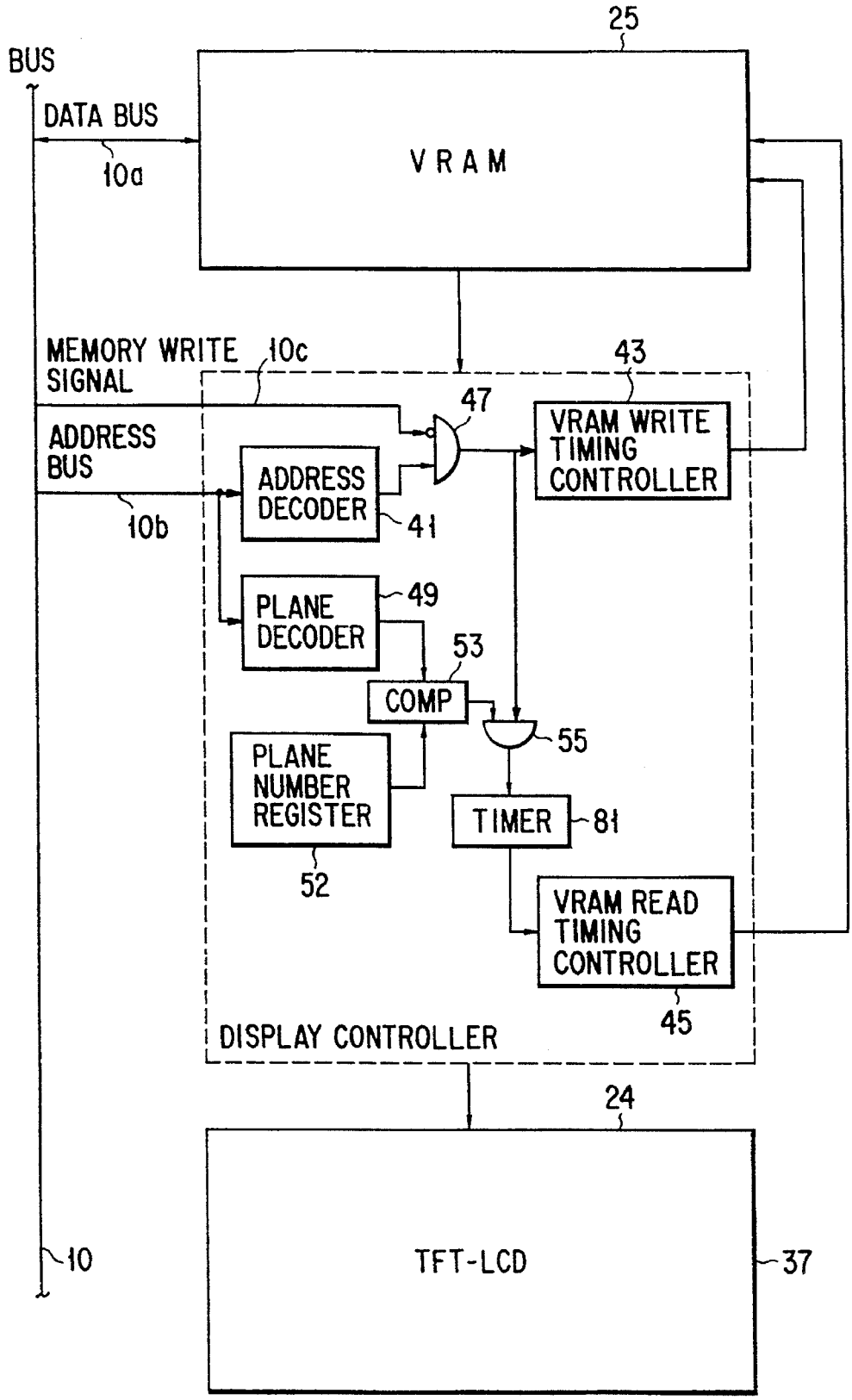
FIG. 4 is a block diagram showing another embodiment of the display controller shown in FIG. 1.

FIG. 4 is a block diagram showing the second embodiment of the present invention. In the second embodiment, a function of inhibiting a read operation of display data from the VRAM 25 when a rewrite operation that does not influence a display content is performed in the VRAM 25 is added to the first embodiment. The same reference numerals in FIG. 4 denote the same parts as in FIG. 2, and a detailed description thereof will be omitted.

In general, the VRAM 25 is constituted by one or a plurality of memory planes. One plane means a video RAM for storing display data for one frame. The display controller 24 selects an arbitrary plane from the plurality of planes, and causes the LCD 37 to display given display data. A plane decoder 49 decodes an address signal input through the address bus **10*b*, and outputs a plane number. A plane number register 52 stores the plane number of a screen display content, which is being displayed on the LCD 37, and outputs the plane number. A comparator 53 compares the number output from the plane decoder 49, and the number output from the plane number register 52**, and outputs a high-level signal "H" when the two numbers coincide with each other.

The operation of the second embodiment will be described below.

The plane decoder 49 converts address data supplied from the CPU 11 through the address bus **10*b* into a plane number, and outputs the plane number to the comparator 53. The plane number register 52 outputs the plane number to the comparator 53. The comparator 53 compares the two plane numbers, and outputs a high-level signal "H" when a coincidence between the two numbers is found. The high-level signal "H" is output to an AND gate 55. An output signal from the AND gate 47 obtained in the same manner as in the first embodiment is also supplied to the AND gate 55. The AND gate 55 outputs a high-level signal "H" to the VRAM read timing controller 45 only when both the input signals are high-level signals "H". More specifically, only when data is written in the memory plane, which is being displayed, the AND gate 55 enables the output signal "H" from the AND gate 47, and sends it to the timer 81**.

As a result, when display data is written in a plane, which does not influence a memory plane which is being displayed on the LCD 37, new display data need not be supplied to the LCD 37, and power consumption can be saved. Note that a controller for setting a read operation of display data in a sleep state is the same as that shown in FIG. 3.

A third embodiment of the present invention will be described below with reference to FIG. 5 and FIGS. 6A through 6H. In the third embodiment, a function of inhibiting display data from being supplied from the VRAM 25 to the LCD 37 when display data to be written in the VRAM 25 is the same data is added to the first embodiment.

Figure 5:
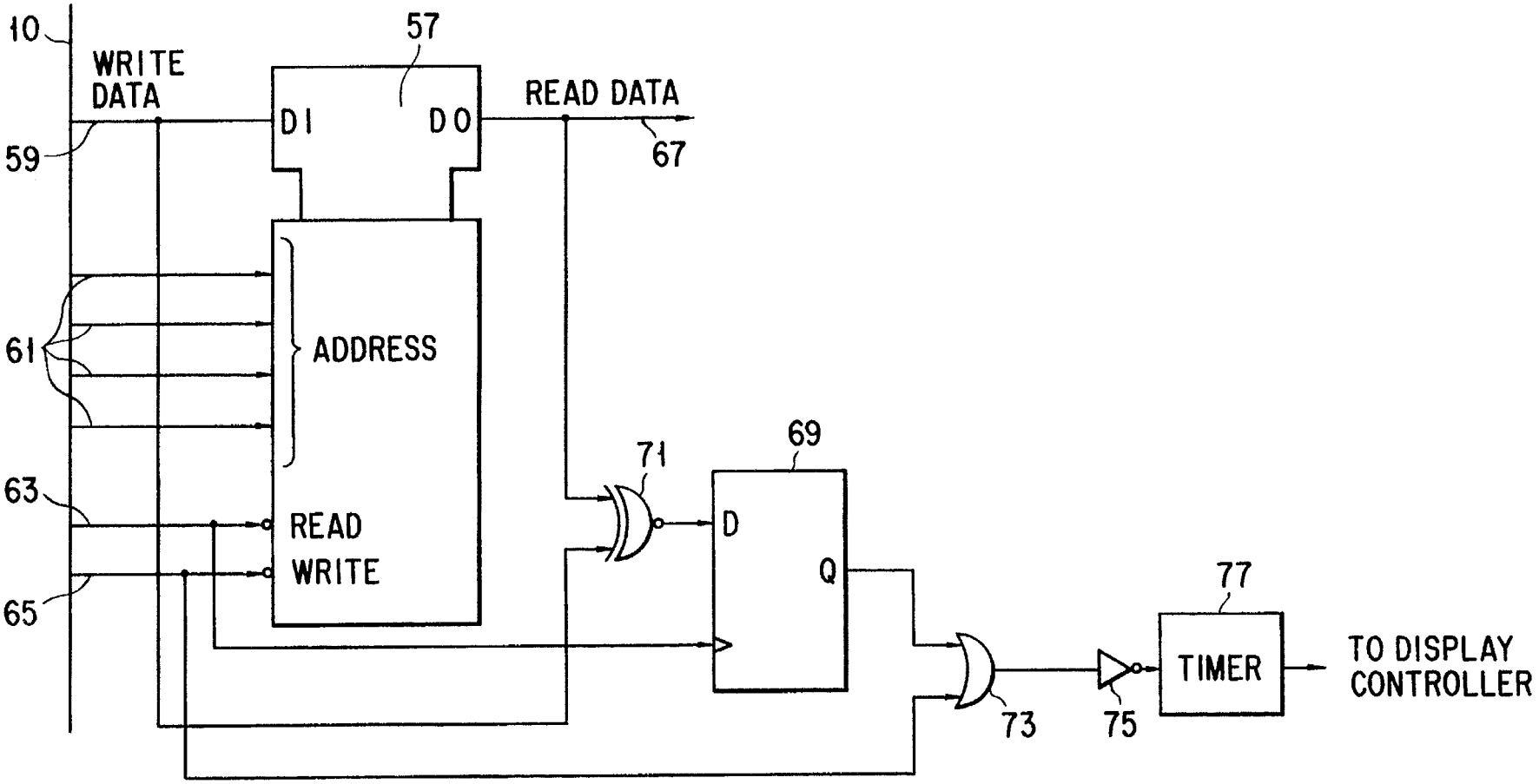
FIG. 5 is a block diagram showing peripheral circuits of a VRAM 5 according to a third embodiment of the present invention.

FIG. 5 shows peripheral circuits of the VRAM 25.

A VRAM chip 57 is connected to a write data line 59, an address line 61, a read line 63, and a write line 65 as lines for receiving signals, and is also connected to a read data line 67 as a line for outputting signals. A comparator (exclusive OR gate) 71 compares read and write data, and outputs a high-level signal "H" when a coincidence is found between the two data. When a read signal is input, a flip-flop 69 holds a signal from the comparator 71, and outputs the held signal to an OR gate 73. When the output from the flip-flop 69 is a high-level signal "H", the OR gate 73 disables a write signal (low-level signal "L"), and outputs a high-level signal "H". When the output signal from the OR gate 73 becomes a low-level signal "L", a timer 77 is reset, and starts a counting operation. At this time, the output from the timer 77 is a low-level signal "L" (indicating that read access of the VRAM 25 is enabled). When the count value of the timer 77 reaches a predetermined value, the timer 77 sets its output as a high-level signal "H" (indicating that read access of the VRAM is set in a sleep state). The output from the timer 77 is supplied to the VRAM read timing controller 45. When the output from the timer 77 is at low level "L", the VRAM read timing controller 45 reads out data from the VRAM 25 at predetermined time intervals, and sends readout data to the LCD. When the output from the timer 77 is at high level "H", the controller 45 sets a data read operation from the VRAM 25 in a sleep state.

The operation of the third embodiment will be described below.

Figures 6A, 6B, 6C, 6D, 6E, 6F, 6G, 6H:
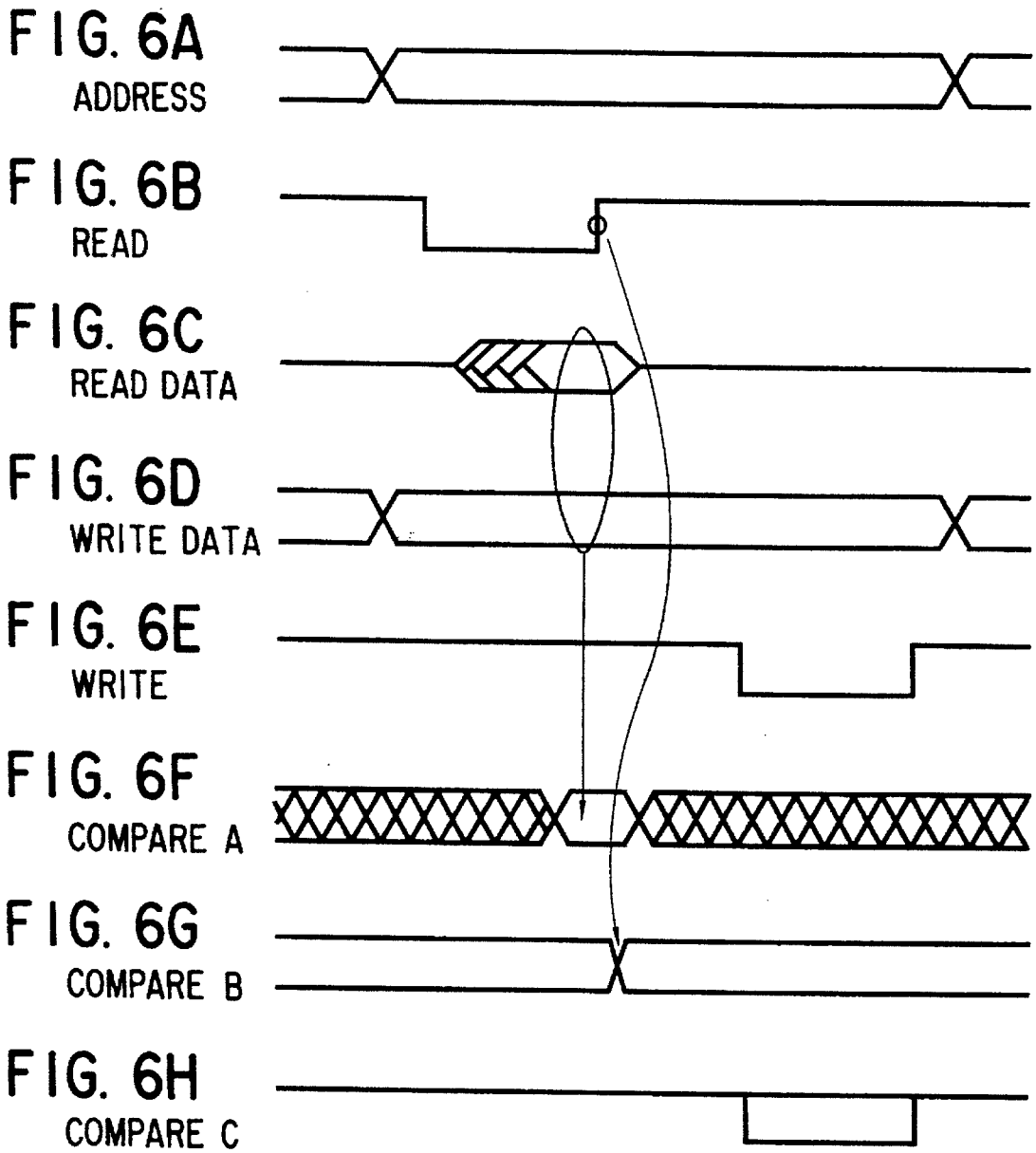
FIGS. 6A through 6H are timing charts showing timing of I/O signals of circuits shown in FIG. 5.

When the CPU 11 rewrites data in the VRAM 25, it outputs an address signal (FIG. 6A) onto the address line 61, a write data signal (FIG. 6D) onto the write data line 59, and a read signal (FIG. 6B) onto the read line 63. In response to the read signal, the VRAM chip 57 outputs data corresponding to the address signal onto the read data line 67, as shown in FIG. 6C. When the write data signal is the same as the read data signal, the exclusive OR gate 71 outputs a high-level signal "H" to the flip-flop 69, as shown in FIG. 6F. The flip-flop 69 fetches the high-level signal "H" from the exclusive OR gate 71 at the leading edge of the read signal, as shown in FIG. 6G, and outputs it to the OR gate 73.

Thereafter, the CPU 11 outputs a write signal (FIG. 6E) onto the write line 65. When the write signal goes to low level "L", the already supplied write data signal is written at the designated address of the VRAM chip 57. The OR gate logically ORs the write signal and the output from the flip-flop 69, and outputs the ORed result to the timer 77, as shown in FIG. 6H.

When the read data signal and the write data signal do not coincide with each other, the exclusive OR gate 71 outputs a low-level signal "L" to the flip-flop 69. The flip-flop 69 latches the low-level signal "L" at the leading edge of the read signal, and outputs it to the OR gate 73. Therefore, the OR gate 73 enables the low-level signal "L" as the write signal on the basis of the low-level signal "L" from the flip-flop 69.

A case will be explained below wherein read and write data coincide with each other. When the two data coincide with each other, the exclusive OR gate 71 outputs a high-level signal "H" to the flip-flop 69. The flip-flop 69 fetches the high-level signal at a timing of the leading edge of the read signal, and outputs it to the OR gate 73. The OR gate 73 receives an active-low write signal. As a result, the OR gate 73 disables the low-level signal "L" as the write signal on the basis of the high-level signal "H" output from the flip-flop 69.

As described above, a signal output from the OR gate 73 is supplied to an inverter 75. The inverter 75 inverts this signal, and supplies the inverted signal to the timer 77. The timer 77 is driven in the same manner as in the first embodiment. The timer 77 performs a counting operation for a predetermined period of time, and sets the VRAM read timing controller 45 in a sleep state.

When display data stored in the VRAM 25 is the same as data to be rewritten, an operation for rewriting the LCD 37 is inhibited, thus saving power consumption.

A fourth embodiment of the present invention will be described below. In FIG. 1, the interval timer 16 counts a time in response to a control signal from the CPU 11. The CPU 11 resets the timer 16 every time it accepts an interrupt signal indicating an input from the keyboard 36. When the timer 16 performs the counting operation for a predetermined period of time, it sends a count end signal to the CPU 11.

A user key-inputs data using the keyboard 36. Input key data is converted into key code data by the keyboard controller 23, and the key code data is temporarily held. A message indicating that a key input is detected is supplied to the interrupt controller 15. Upon reception of this message, the interrupt controller 15 sends an interrupt command to the CPU 11. Upon reception of the interrupt command, the CPU 11 reads out the key code data from the keyboard controller 23. The CPU 11 which received the key code data converts the key code data into a character pattern, and writes it in the VRAM 25. The display controller 24 reads out display data from the VRAM 25 at predetermined time intervals, and sends the readout data to the TFT LCD 37. Upon reception of the interrupt command from the interrupt controller 15, the CPU 11 sends a reset signal to the timer 16. The timer 16 clears the counter in response to the reset signal, and starts a counting operation of a time again.

When the timer 16 counts a predetermined period of time, it sends a count end signal to the CPU 11. Upon reception of this signal, the CPU 11 supplies a control signal for setting a read operation of display data from the VRAM 25 in a sleep state to the display controller 24. The display controller 24 sets a read operation from the VRAM 25 in a sleep state on the basis of this control signal.

In this manner, only when display data is changed, the display data is supplied to the LCD 37, thus saving power consumption.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An electronic apparatus, comprising:

a central processing unit (CPU);

storage means for storing display data which is read out based on a read timing signal;

a display device for displaying the display data read out from the storage means;

read timing control means for periodically generating and supplying the read timing signal to the storage means; and detection means for detecting that a write request from the CPU to the storage means has not been received for a predetermined period of time, and for supplying a sleep signal to the read timing control means in response to the detection, whereby the read timing control means stops supplying the read timing signal upon receiving the sleep signal from the detection means.

2. The electronic apparatus according to claim 1, wherein display data in the storage means is periodically rewritten, and wherein the electronic apparatus further comprises:

coincidence detection means for detecting whether or not rewritten display data in the storage means is the same as display data in the storage means before rewriting; and second detection means for, when the coincidence detection means detects that rewritten display data is the same as display data in the storage means before rewriting, determining that no display data is rewritten, and for detecting that display data stored in the storage means has not been rewritten for a predetermined period of time, and wherein when the second detection means detects that display data has not been rewritten, the read timing control means stops supplying the read timing signal upon receiving the sleep signal from the detection means.

3. The electronic apparatus according to claim 1, wherein the display device is a thin film transistor (TFT) liquid crystal display (LCD) for holding display data read out from the storage means in units of pixels, and for displaying display data.

4. The electronic apparatus according to claim 1, wherein the storage means has a first display data storage area for storing display data that is being displayed on the display device, and a second display data storage area for storing display data that is not being displayed on the display device, the electronic apparatus further comprising:

display data rewrite detection means for detecting whether or not display data stored in the first display data storage area has not been rewritten for a predetermined period of time, whereby the read timing control means stops supplying the read timing signal when the display data rewrite detection means detects that display data stored in the first display data storage area has not been rewritten for the predetermined period of time.

5. An electronic apparatus, comprising:

a central processing unit (CPU);

storage means for storing display data which is read out based on a read timing signal;

a display device for displaying display data read out from the storage means;

detecting means for detecting an address specifying a location of the storage means and a memory write signal from the CPU, and for outputting an active signal in response to the detection;

counter means for counting a predetermined period of time to output a sleep signal, the counter means being reset by receiving the active signal from the detecting means; and timing signal generating means for generating a read timing signal for the storage means until receiving the sleep signal from the counter means.

6. The electronic apparatus according to claim 5, wherein display data in the storage means is periodically rewritten, the electronic apparatus further comprising:

coincidence detection means for detecting whether or not rewritten display data in the storage means is the same as display data in the storage means before rewriting, whereby the detecting means stops outputting an active signal when the coincidence detection means detects that the rewritten display data is the same as the display data before rewriting.

7. The electronic apparatus according to claim 5, wherein the display device is a thin film transistor (TFT) liquid crystal display (LCD) for holding display data read out from the storage means in units of pixels, and for displaying display data.

8. The electronic apparatus according to claim 5, wherein the storage means has a first display data storage area for storing display data which is being displayed on the display device, and a second display data storage area for storing display data which is not being displayed on the display device, and the apparatus further comprising:

display data rewrite operation means for detecting whether or not display data stored in the first display data storage area has not been rewritten for a predetermined period of time, whereby the detecting means stops outputting the active signal when the display data rewrite detection means detects that display data stored in the first display data storage area has not been rewritten for the predetermined period of time.

9. An electronic device comprising:

storage means for storing video data and for outputting the video data in response to a read timing signal;

a display device for displaying the video data output from the storage means;

a read timing controller for periodically generating and supplying the read timing signal to the storage means;

detecting means for detecting whether or not video data is written into the storage means and for outputting a status signal indicating a result of the detection; and a timer having a counter to count a predetermined period of time and for supplying a sleep signal to the detecting means when the counter counts the predetermined period of time, whereby the read timing controller stops supplying the read timing signal upon receiving the sleep signal.

10. The electronic apparatus according to claim 9, wherein video data in the storage means is periodically rewritten, further comprising:

coincidence detection means for detecting whether or not rewritten video data in the storage means is the same as the video data in the storage means before rewriting; and second detection means for, when the coincidence detection means detects that the rewritten video data is the same as the video data in the storage means before rewriting, determining that no video data is rewritten, and detecting that video data stored in the storage means has not been rewritten for a predetermined period of time, and wherein when the second detection means detects that video data has not been rewritten, the read timing controller stops supplying the read timing signal upon receiving the sleep signal from the timer.

11. The electronic apparatus according to claim 9, wherein the display device is a thin film transistor (TFT) liquid crystal display (LCD) for holding video data read out from the storage means in units of pixels, and for displaying the video data.

12. The electronic apparatus according to claim 9, wherein the storage means has a first display data storage area for storing video data that is being displayed on the display device, and a second display data storage area for displaying video data that is not being displayed on the display device, and the electronic apparatus further comprising:

display data rewrite detection means for detecting whether or not video data stored in the first display data storage area has not been rewritten for a predetermined period of time, whereby the read timing controller stops supplying the read timing signal when the display data rewrite detection means detects that video data stored in the first display data storage area has not been rewritten for the predetermined period of time.

13. An electronic device, comprising:

storage means for storing video data and for outputting the video data in response to a read timing signal;

a display device for displaying the video data output from the storage means;

detecting means for detecting whether or not the video data is written into the storage means and for outputting a status signal indicating a result of the detection;

a timer having a counter to count a predetermined period of time, for supplying a sleep signal to read timing controller when the counter counts the predetermined period of time, and for supplying a release signal to the read timing controller when the detecting means detects the write operation; and read timing controller having an active mode and a sleep mode, the active mode generating and supplying the read timing signal to the storage means periodically, the sleep mode stopping generating the read timing signal to the storage means periodically.

14. The electronic apparatus according to claim 13, wherein video data in the storage means is periodically rewritten, further comprising:

coincidence detection means for detecting whether or not rewritten video data in the storage means is the same as the video data before rewriting; and second detection means for, when the coincidence detection means detects that the rewritten video data is the same as the video data before rewriting, determining that no video data is rewritten, and detecting that video data stored in the storage means has not been rewritten for a predetermined period of time, and wherein when the second detection means detects that video data has not been rewritten, the read timing controller stops supplying the read timing signal upon receiving the sleep signal from the timer.

15. The electronic apparatus according to claim 13, wherein the display device is a thin film transistor (TFT) liquid crystal display (LCD) for holding video data read out from the storage means in units of pixels, and for displaying the video data.

16. The electronic apparatus according to claim 13, wherein the storage means has a first display data storage area for storing video data which is being displayed on the display device, and a second display data storage area for displaying video data which is not being displayed on the display device, and the apparatus further comprising:

display data rewrite operation means for detecting whether or not video data stored in the first display data storage area has not been rewritten for a predetermined period of time, whereby the read timing controller stops supplying the read timing signal when the video data rewrite detection means detects that data stored in the first display data storage area has not been rewritten for the predetermined period of time.

17. A method for deactivating a display controller in a computer including a counter and a video random access memory (VRAM), wherein the display controller uses a read timing signal to initiate reading of display data from the VRAM, the method performed by the computer comprising the steps of:

a) detecting an address specifying a location in the VRAM for storing display data;

b) initializing the counter in response to the detection;

c) counting a period of time in response to the detection and following the initialization;

d) generating a sleep signal when the counter reaches a predetermined value;

e) deactivating the display controller in response to the sleep signal by halting the read timing signal.

* * * * *

UNITED STATES PATENT AND TRADEMARK OFFICE

CERTIFICATE OF CORRECTION

PATENT NO. : 5,515,080

DATED : May 07, 1996

INVENTOR(S) : Nobutaka NAKAMURA

It is certified that error appears in the above-indentified patent and that said Letters Patent is hereby corrected as shown below:

Claim 9, column 10, line 44, after "device", insert --,--.

Signed and Sealed this

Third Day of December, 1996

Bruce Lehman

*Attest:*

BRUCE LEHMAN

*Attesting Officer*

*Commissioner of Patents and Trademarks*